US009958246B2

(12) United States Patent
Davis

(10) Patent No.: US 9,958,246 B2
(45) Date of Patent: May 1, 2018

(54) MULTI-WAY TUBULAR CHANNEL CONNECTOR BLOCK

(71) Applicant: MASTER BLASTER PROPRIETARY LIMITED, Centurion (ZA)

(72) Inventor: Mark Rodney Davis, Centurion (ZA)

(73) Assignee: MASTER BLASTER PROPRIETARY LIMITED, Centurion (ZA)

( * ) Notice: Subject to any disclaimer, the term of this patent is extended or adjusted under 35 U.S.C. 154(b) by 157 days.

(21) Appl. No.: 15/031,254

(22) PCT Filed: Oct. 15, 2014

(86) PCT No.: PCT/ZA2014/000057

§ 371 (c)(1),
(2) Date: Apr. 21, 2016

(87) PCT Pub. No.: WO2015/085330

PCT Pub. Date: Jun. 11, 2015

(65) Prior Publication Data

US 2016/0258731 A1 Sep. 8, 2016

(30) Foreign Application Priority Data

Oct. 24, 2013 (ZA) ..... 2013/07947

(51) Int. Cl.
*C06C 5/04* (2006.01)
*F42D 1/04* (2006.01)

(52) U.S. Cl.
CPC ..... *F42D 1/043* (2013.01)

(58) Field of Classification Search
CPC ..... C06C 5/06; F42D 1/043
See application file for complete search history.

(56) References Cited

U.S. PATENT DOCUMENTS 3,706,277 A * 12/1972 Willard ..... C06C 5/06 102/275.3
4,023,493 A 5/1977 Austin et al.
(Continued)

FOREIGN PATENT DOCUMENTS

| | | | |
|---|---|---|---|
| FR | 1000774 | A | 2/1952 |
| WO | 97/25298 | A1 | 7/1997 |
| WO | 2009/076682 | A2 | 6/2009 |

*Primary Examiner* — Gabriel Klein
(74) *Attorney, Agent, or Firm* — Maschoff Brennan

(57) ABSTRACT

The invention provides a multi-way tubular connector block including a body having a primary tubular channel of a first diameter, one or more resiliently deformable plug portions having secondary tubular channels of a secondary diameter there through, and a securing mechanism for securing the plug portions to the body, wherein the body has at least two openings or ports in communication with the primary tubular channel, and wherein the secondary diameters of the secondary channels are sized and dimensioned to permit snug fitting of a shock tube therein so that, in use, a plurality of shock tubes are secured in the plug portions so that at least some open ends of the shock tubes are in communication with the primary tubular channel. The invention extends to a multi-way composite connector block having a plurality of multi-way tubular connector block portions substantially as described above.

20 Claims, 5 Drawing Sheets

(56) References Cited

U.S. PATENT DOCUMENTS

| | | | | |
|---|---|---|---|---|
| 4,911,076 | A * | 3/1990 | Rowe | C06C 5/06 102/275.3 |
| 5,012,741 | A | 5/1991 | Peebles et al. | |
| 5,413,046 | A * | 5/1995 | Sobczak | C06C 5/04 102/275.3 |
| 6,272,996 | B1 * | 8/2001 | O'Brien | C06C 5/06 102/275.1 |
| 8,402,892 | B1 * | 3/2013 | Scheid | C06C 5/06 102/217 |
| 2004/0207669 | A1 * | 10/2004 | Stadler | B41J 3/407 347/9 |
| 2008/0295725 | A1 * | 12/2008 | Xiaohong | C06C 5/06 102/206 |
| 2009/0071362 | A1 | 3/2009 | Scheid | |
| 2010/0300315 | A1 * | 12/2010 | Davis | F42D 1/043 102/206 |

* cited by examiner

MULTI-WAY TUBULAR CHANNEL CONNECTOR BLOCK

FIELD OF THE INVENTION

The invention relates to mining explosives but can have application in uses of other explosives, such as construction, demolition, and the like. In particular, the invention relates to a connector block used in propagating explosives initiation signals.

BACKGROUND OF THE INVENTION

The inventor is aware of several types of connector blocks, first of which is a simple single channel connector block wherein a channel open at one end thereof for the insertion of a detonator is used and side walls of shock tubes to which the signal is to be propagated are brought into close proximity of the closed end of the channel so that when the detonator detonates, the shockwave of the detonation fractures the shock tube side wall and propagates the signal along the shock tubes. This is sometimes known as a C-clip or G-clip arrangement. This type of connector block only works with detonators and has other geometric limitations.

A second type connector block is described international patent WO2009076682 to the same inventor, which there is provided a multi-port transmission line connector having a body which has at least four ports and channels therein for connecting one final transmission line with multiple signal transmission lines in a blasting system or transferring blasting signals, the at least four ports having a bore there through, wherein in at least one of the ports is located an inner sleeve of deformable material and located between the inner sleeve and the body a crimpable secondary sleeve such that, in use, when a shock tube has been inserted into the port and passes through the inner sleeve portion of the secondary sleeve crimped thereby to deform the inner sleeve and to seal against the shock tube thereby retaining the shock tube in position and inhibiting the ingress of water into the connector through said port. This type of connector block has advantageous over the prior connector blocks but through its multi-dimensional structure is costly to produce.

The inventor thus identified a need for a multi-port connector block with the advantageous the block WO2009078682 while simplifying manufacture and reducing the costs thereof.

SUMMARY OF THE INVENTION

According to a first aspect of the invention, there is provided a multi-way tubular connector block including

- a body having a primary tubular channel of a first diameter;
- one or more resiliently deformable plug portions having secondary channels of a secondary diameter there through; and
- a securing mechanism for securing the plug portions to the body, wherein the body has at least two openings or ports in communication with the primary tubular channel, the securing mechanism for securing the resiliently deformable plug portion being provided on at least on of the ports, and wherein the secondary diameters of the secondary channels are sized and dimensioned to permit snug fitting of a shock tube therein so that, in use, a plurality of shock tubes are secured in the plug portions so that at least some open ends of the shock tubes are in communication with the primary tubular channel.

The primary tubular channel may be a chamber having curved end ones. Said end zones may be semi-spherical or hemi-spherical.

The chamber may however be a flat cylindrical tubular chamber with end zones perpendicular to the side walls thereof.

At at least one chamber end zone there may be an or reduced diameter in respect to the primary channel. This may result in venturi type effect or pressure chamber effect whereby an initiation signal passing from the secondary channels into the primary tubular channel experiences a pressure increase before the orifice and is introduced into the tubular channel creating a higher pressure for signal transfer and propagation. This promotes propagation of a signal, such as a shock wave or a flame front, from a signal initiation device or source, into the primary tubular channel and then onwards from within the primary channel to the plurality of shock tubes.

At one or more of the ports, an attachment means may be provided whereby one or more detonator, igniter, or a delayed igniter, being the source of the initiation signal, is attached and secured in communication with the primary tubular channel so that a signal propagating through said primary tubular channel initiates shock tube by means of said detonator or igniter.

The attachment means may be a screw threaded or bayonet type formation to receive and attach a complementary formation on said igniter or detonator body. Said screw threads or bayonet formation may be on the outer or inner zone of the port.

The plug portion may have one or more, typically at least 2 secondary (channels there through, which channels are preferably equi-spaced from each other, typically, the plug portion has 3 to 5 secondary channels there through.

The body may be made of a plastics material.

The securing mechanism may be in the form of an aluminum, or other metal, tube which protrudes and is secured into the body and, in use, when a plug portion is inserted into the securing mechanism, a portion of the metal tube which extends from out of the body is crimped onto the plug portion thereby securing the plug portion in position.

A waterproofing material may be applied to the tube prior to crimping, however, in most cases the crimping action alone and the deformability of the plug portion results in a waterproof seal.

According to second aspect of the invention, there is provided a multi-way composite connector block having a plurality of multi-way tubular connector block portions substantially as described above, wherein one port of each of said tubular connector blocks is secured in communication with a corresponding port of at least one other of said tubular connector blocks, the composite multi-way connector block including one or more initiation ports into which one or more detonators and/or igniters are secured, so that in use when the igniters and/or detonators are initiated, a signal is propagated to each of the tubular connector blocks and through said connector block out along a plurality of shock tubes.

The tubular connector blocks of the composite multi-way connector block may be in communication with each other through a hub or central chamber shaped and dimensioned to promote propagation of the signal, for example, by being curved or spherical or conical or by having channels therethrough linking specific tubular connector block portions to each other.

The composite multi-way connector block may be made by connecting independent multi-way tubular channel connector blocks or by integrally forming the composite multi-way connector block with multi-way tubular channel connector block like portions.

The composite multi-way connector block may be used in open cast mining applications.

The multi-way tubular channel connector block may be used in underground or open cast applications.

DESCRIPTION OF AN EMBODIMENT OF THE INVENTION

The invention will now be described by way of nonlimiting example only, with reference to the accompanying diagrammatic drawings. In the drawings, FIG. 1 shows, in schematic representation, a multi-way tubular channel connector block in accordance with the invention;

Figure 1:
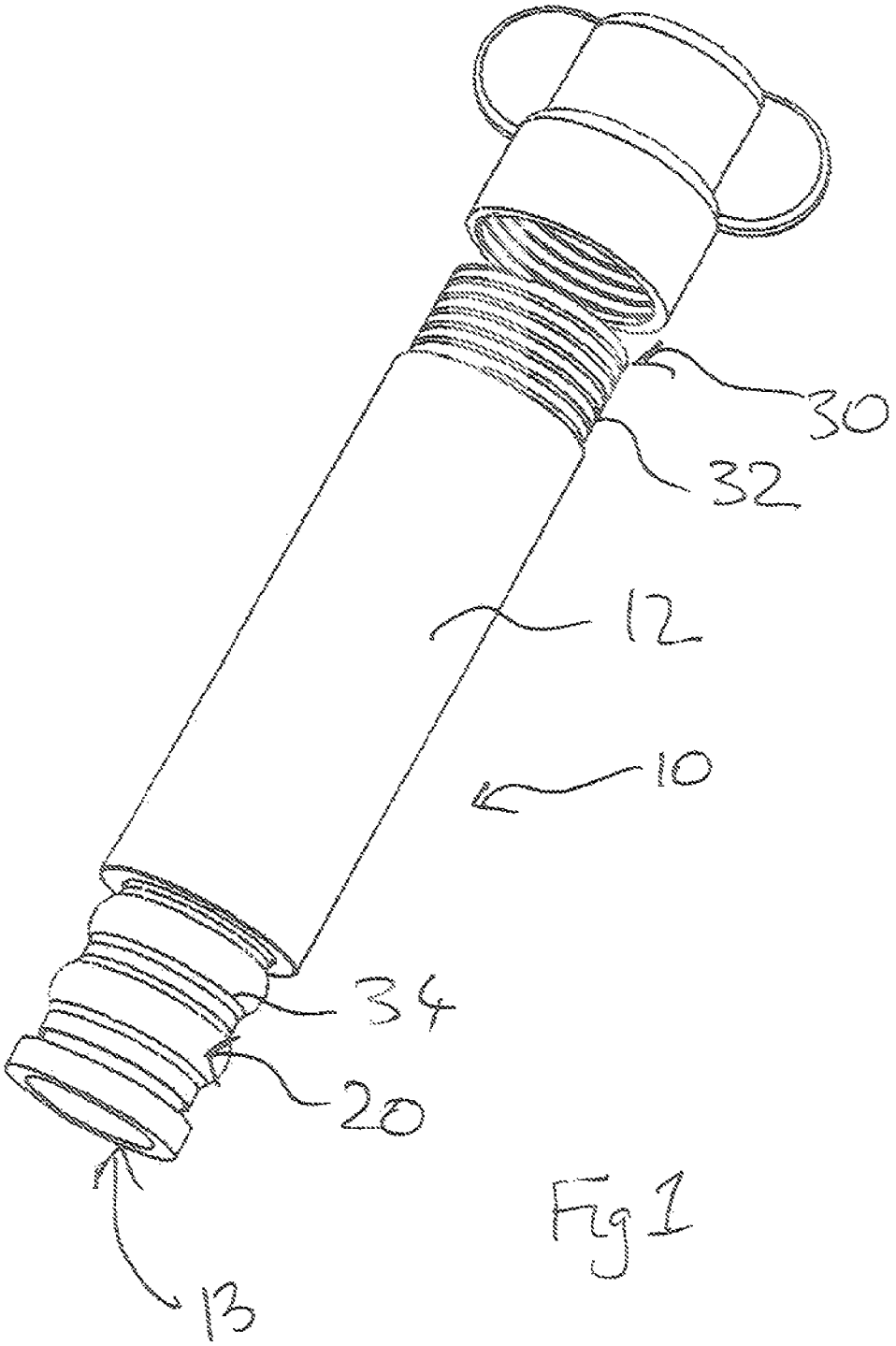
Figure 2:
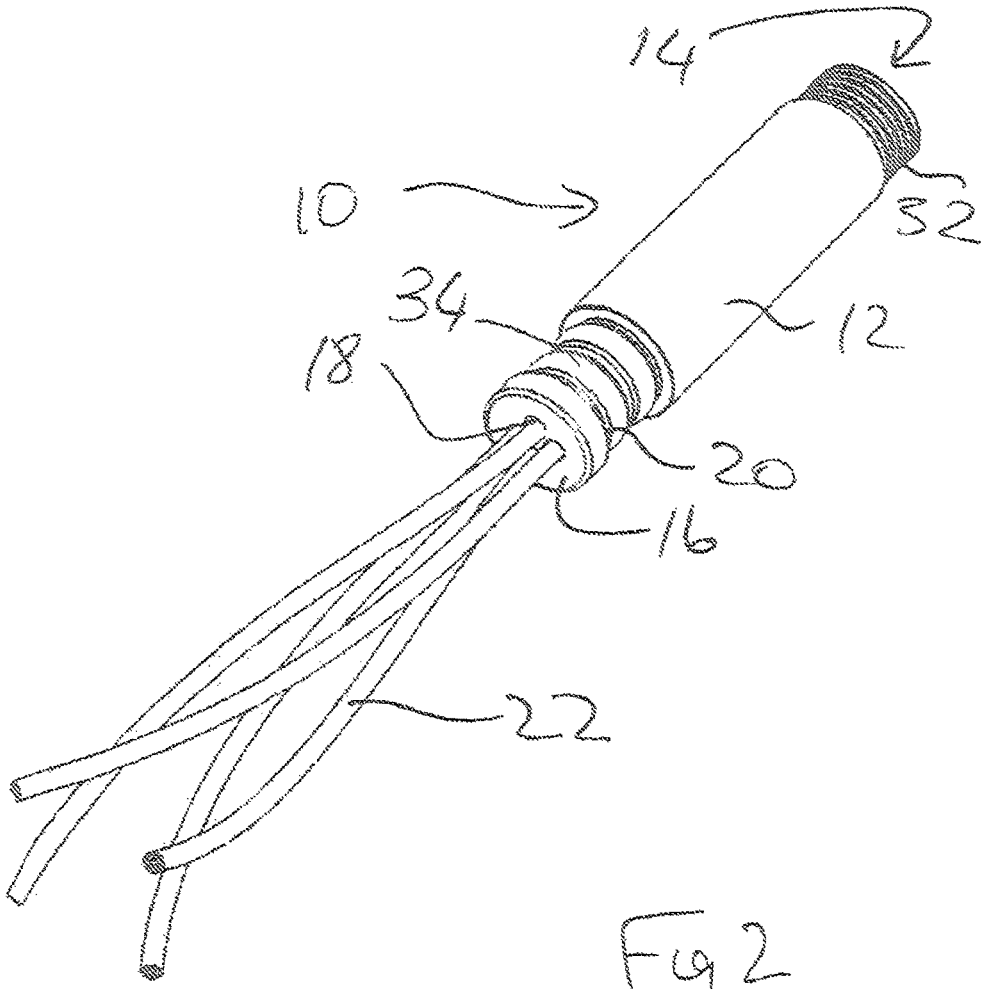
FIG. 2 shows, in isometric end view, the multi-way connector block of FIG. 1.
Figure 3:
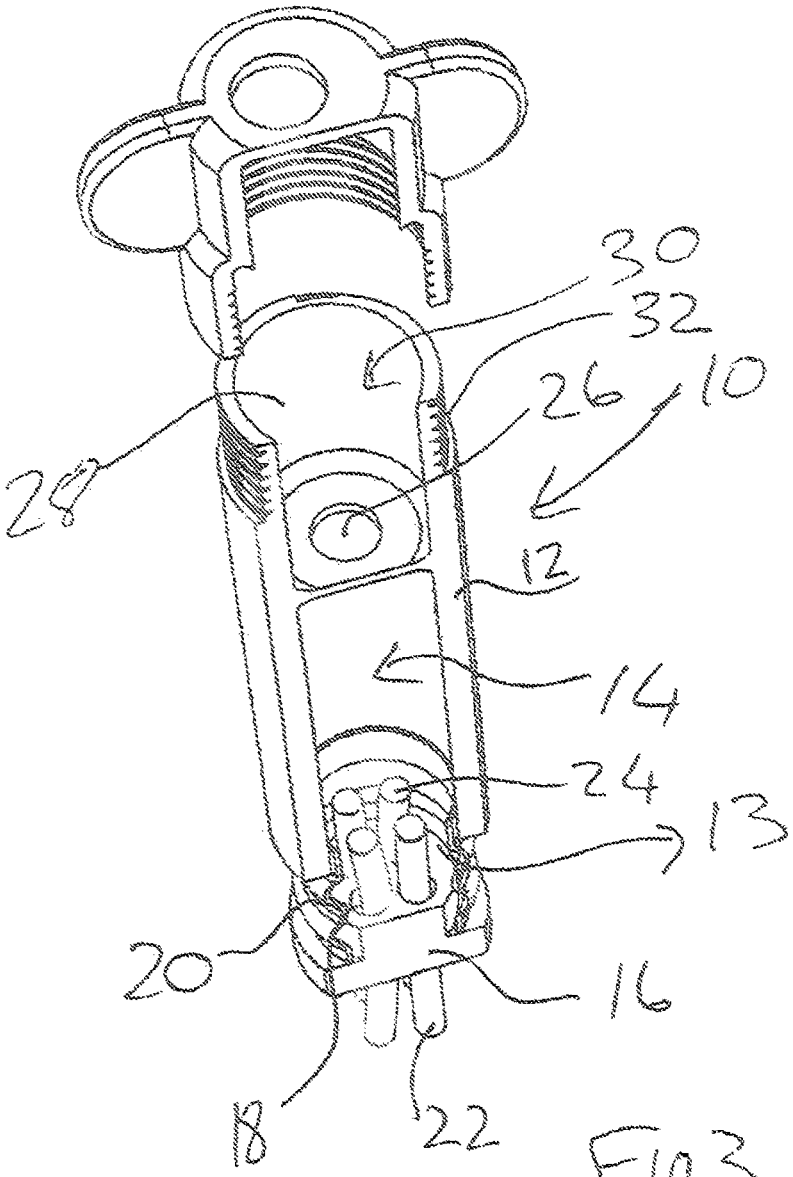
FIG. 3 shows a cross sectional drawings of the connector block of FIG. 1.

In FIGS. 1 to 3, a 4-way tubular channel connector block 10 is shown. The connector block 10 includes

- a body 12 made of a plastics material and having a primary tubular channel 14 of a first diameter;
- two ports 13 and 30 at end zones thereof;
- a resiliently deformable plug portion 16 made of rubber or a similar substance, and having 4 secondary channels 18 of a secondary diameter there through; and
- a securing mechanism 20 for securing the plug portion 16 to the body 12, wherein the body 12 has an opening in communication with the primary tubular channel 14, the securing mechanism 20 for securing the resiliently deformable plug portion 16 being provided at port 13, and wherein the secondary diameters of the secondary channels 18 are sized and dimensioned to permit snug fitting of a shock tube 22 therein so that, in use, a plurality of shock tubes 22 are secured in the plug portion 16 so that at least some open ends 24 of the shock tubs 22 are in communication with the primary tubular channel 14.

The primary tubular channel 14 is chamber being a cylindrical tubular chamber with zones perpendicular to the side walls thereof. One chamber 14 end zone 24 has an orifice 26 or reduced diameter in respect to the primary channel 14. This may result in a pressure chamber effect whereby an initiation signal passing from the secondary channels 18 into the primary tubular channel 14 experiences a pressure increase before the orifice 26 and is introduced into the tubular channel 14 creating higher pressure for signal transfer and propagation. This promotes propagation of a signal, such as a shock wave or a flame front, from a signal initiation device or into the primary tubular channel and then onwards within the primary channel to the plurality of shock tubes.

At the other end 28 of the tubular channel 14 there is a port 30 provided with an attachment means 32 in the form of a screw threaded portion whereby a detonator, igniter, or a delayed igniter being the source of the initiation signal is attached and secured in the communication with the primary tubular channel 14.

The plug portion 16 has 4 secondary channels there through, which channel are equi-spaced from each other.

The securing mechanism 20 may be in the form of an aluminum or other metal, tube 34 which protrudes and is secured into the body 12 and, in use when the plug portion 16 is secured into the securing mechanism by crimping a free portion of the tube 34 onto the plug portion 16 thereby securing the plug portion 16 in position. The crimping action alone and the deformability of the plug portion 16 results in a waterproof seal.

Figure 4:
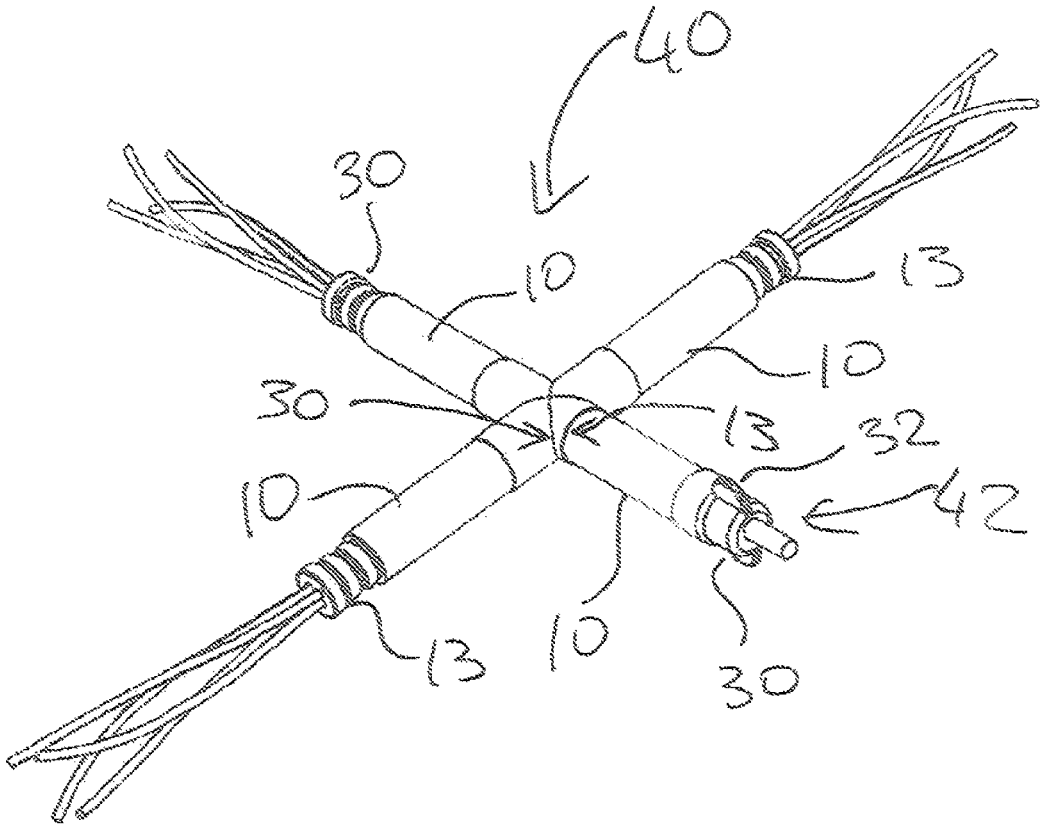
FIG. 4 shows a composite connector block having 4 ports made of 4 connector block like portions of FIG. 1.

In FIG. 4, there is shown a composite multi-way connector block 40 having a plurality of multi-way tubular connector block portions 10 of FIGS. 1 to 3, wherein port 13 or 30 (not visible on drawing as it is inside) of each of said tubular connector blocks 10, a required, is secured in communication with a corresponding port 13 or 30 of at least one other of said tubular connector blocks, the composite multi-way connector block 40 including an initiation port 42, is port 30 of one of the tubular connector block portions 10 into which one or more detonators and/or igniters are secured by means of screw threaded arrangement 32, so that in use when the igniters and/or detonators are initiated, a signal is propagated to each of the tubular connector block portion 10 and through said connector block portions 10 out along a plurality shock tubes. The four portions 10 may be secured together or be integrally formed.

The tubular connector block portions 10 of the composite multi-way connector block 40 may be in communication with each other through a hub or central champ shaped and dimensioned to promote propagation of the signal, for example, by being curved or spherical or conical or by having channels therethrough linking specific tubular connector block portions to each other.

Figure 5:
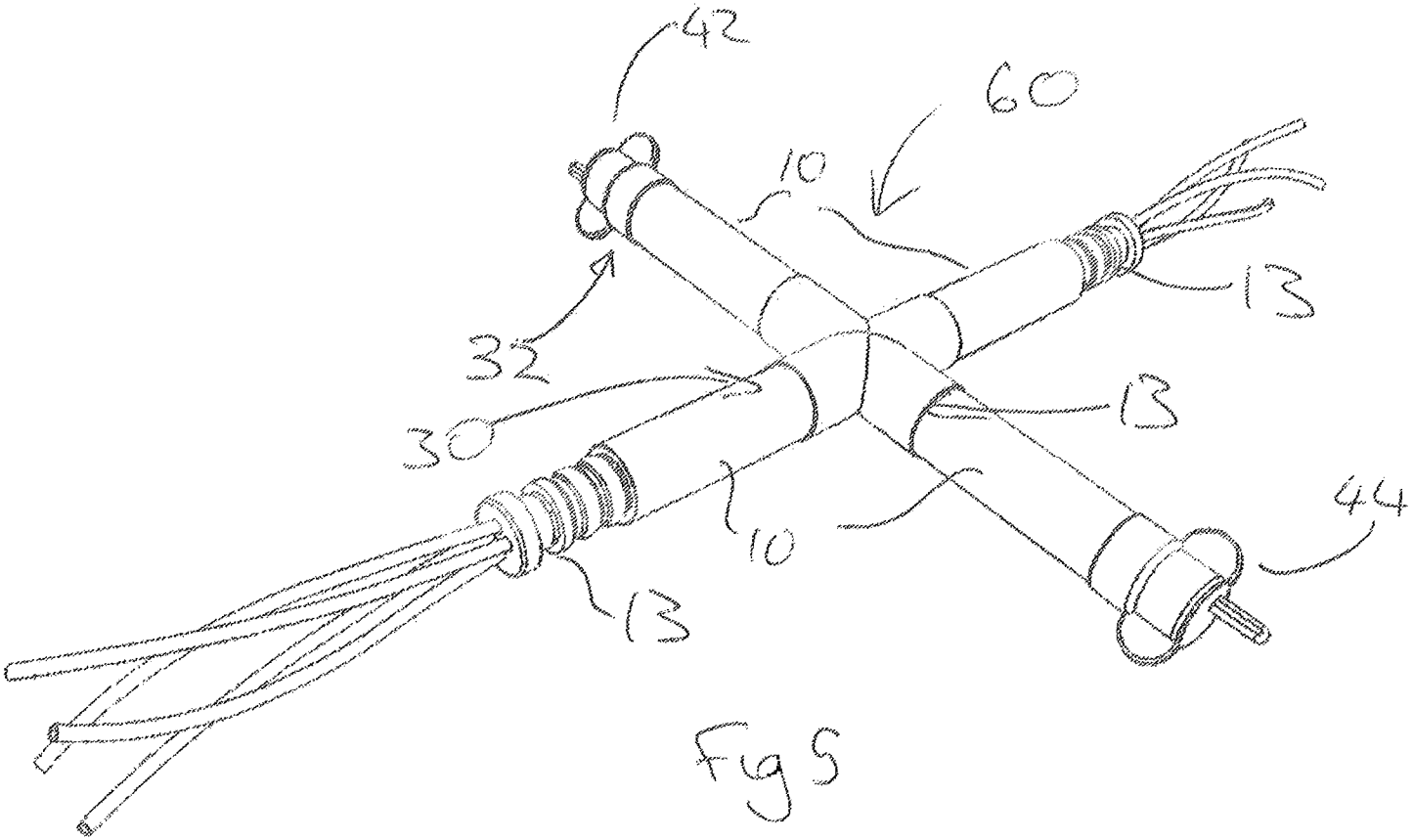
FIG. 5 shows another embodiment of the composite connector block of FIG. 4.

In FIG. 5, there is shown a composite multi-way connect block 60 having a plurality of multi-way tubular connector block portions 10 of FIGS. 1 to 3, wherein port 13 or 30 (not visible on drawing as is inside) of each of said tubular connector blocks 10, as require, is secured in communication with a corresponding port 13 or 30 of at least one other of said tubular connector blocks, the composite multi-way connector block including initiation ports 42, 44, each of which is port 30 of one of the tubular connector block portions 10 into which one or more detonators and/or igniters are secured by means of a screw threaded arrangement 32, so that in use when the igniter and/or detonators are initiated, a signal is propagated to each of the tubular connector block portions 10 and through said connector block portions 10 out along a plurality of shock tubes. The four portions 10 may be secured together or be integrally formed.

The tubular connector block portions 10 of the composite multi-way connector block 60 may be in communication with each other through hub or central chamber shaped and dimensioned promote propagation of the signal, for example, by being curved or spherical or conical or by having channels therethrough linking specific tubular connector block portions to each other.

The composite multi-way connector block 10 may be used in open cast mining applications.

The multi-way tubular channel connector block 40, 60 may be used in underground or open cast applications.

The invention claimed is:

1. A multi-way composite connector block including a plurality of multi-way tubular connector blocks, each tubular connector block including a body having a primary tubular channel of a first diameter;

one or more resiliency deformable plug portions having secondary tubular channels of a secondary diameter there through; and a securing mechanism for securing the plug portions to the body, wherein the body has at least two openings or ports in communication with the primary tubular channel, the securing mechanism for securing the resiliency deformable plug portion being provided on at least one of the ports, and wherein the secondary diameters of the secondary tubular channels are sized and dimensioned to permit snug fitting of a shock tube therein so that, in use, a plurality of shock tubes are secured in the plug portions so that at least some open ends of the shock tubes are in communication with the primary tubular channel; and wherein one port of each of said tubular connector blocks is secured in communication with a corresponding port of at least one other of said tubular connector blocks, the composite multi-way connector block including one or more initiation ports into which one or more detonators or igniters are secured, so that in use when the igniters or detonators are initiated, a signal is propagated to each of the tubular connector blocks and through said connector block out along a plurality of shock tubes.

2. A multi-way composite connector block as claimed in claim 1, wherein, for at least one of the tubular connector blocks, the primary tubular channel is a chamber having curved end zones.

3. A multi-way composite connector block as claimed in claim 2, wherein the end zones of the at least one tubular connector block are semi-spherical or hemi-spherical.

4. A multi-way composite connector block as claimed in claim 2, wherein, for the at least one tubular connector block, at at least one chamber end zone, there is an orifice or reduced diameter in respect to the primary tubular channel which results in a venturi type effect or pressure chamber effect whereby an initiation signal passing from the secondary channels into the primary tubular channel experiences a pressure increase before the orifice and is introduced into the primary tubular channel creating a higher pressure for signal transfer and propagation thereby to promote propagation of a signal from a signal initiation device or source, into the primary tubular channel and then onwards from within the primary tubular channel to the plurality of shock tubes.

5. A multi-way composite connector block as claimed in claim 4, wherein, for the at least one tubular connector block, at one or more of the ports, an attachment means is provided whereby an igniter, or a delayed igniter, being the source of the initiation signal, is attached and secured in communication with the primary tubular channel so that a signal propagating through said primary tubular channel initiates the shock tube by means of said igniter.

6. A multi-way composite connector block as claimed in claim 5, wherein the attachment means is a screw threaded or bayonet type formation to receive and attach a complementary formation on a body of said igniter.

7. A multi-way composite connector block as claimed in claim 6, wherein the screw threads or bayonet formation is on an outer or inner zone of the port.

8. A multi-way composite connector block as claimed in claim 1, wherein the primary tubular channel for at least one of the tubular connector blocks is a chamber that is a flat cylindrical tubular chamber with end zones perpendicular to side walls thereof.

9. A multi-way composite connector block as claimed in claim 1, wherein, for at least one of the tubular connector blocks, each of the one or more plug portions has at least 2 secondary channels there through.

10. A multi-way composite connector block as claimed in claim 9, in which the channels are equi-spaced from each other.

11. A multi-way composite connector block as claimed in claim 9, wherein at least one of the plug portions has 3 to 5 secondary channels there through.

12. A multi-way composite connector block as claimed in claim 1, wherein, for at least one of the tubular connector blocks, the body is made of a plastics material.

13. A multi-way composite connector block as claimed in claim 1, wherein, for at least one of the tubular connector blocks, the securing mechanism is in the form of an aluminium, or other metal, tube which protrudes and is secured into the body and, in use, when a plug portion is inserted into the securing mechanism, a portion of the metal tube which extends from out of the body is crimped onto the plug portion thereby securing the plug portion in position.

14. A multi-way composite connector block as claimed in claim 13, wherein waterproofing material is applied to the tube prior to crimping.

15. A multi-way composite connector block as claimed in claim 13, in which the crimping action alone and the deformability of the plug portion results in a waterproof seal.

16. A multi-way composite connector block as claimed in claim 1, wherein at least one of the tubular connector blocks includes one or more detonators and igniters.

17. A multi-way composite connector block as claimed in claim 1, the tubular connector blocks of the composite multi-way connector block are in communication with each other through a hub or central chamber shaped and dimensioned to promote propagation of the signal.

18. A multi-way composite connector block as claimed in claim 17, wherein the central chamber is curved or spherical or conical having channels therethrough linking specific tubular connector block portions to each other.

19. A multi-way composite connector block as claimed in claim 1, wherein the composite multi-way connector block is made by connecting independent multi-way tubular channel connector blocks.

20. A multi-way composite connector block as claimed in claim 1, wherein the composite multi-way connector block is made by integrally forming the composite multi-way connector block from multi-way tubular channel connector block like portions.

* * * * *